United States Patent [19]

Grant

[11] Patent Number: 5,015,333

[45] Date of Patent: May 14, 1991

[54] MULTI-STAGE PULP WASHING WITHIN A BATCH DIGESTER

[75] Inventor: Ralph S. Grant, Beaverton, Oreg.

[73] Assignee: Beloit Corporation, Beloit, Wis.

[21] Appl. No.: 68,721

[22] Filed: Jun. 29, 1987

Related U.S. Application Data

[63] Continuation-in-part of Ser. No. 515,493, Jul. 20, 1983, abandoned.

[51] Int. Cl.[5] ..... D21C 9/00; D21C 9/04

[52] U.S. Cl. ..... 162/60; 162/51

[58] Field of Search ..... 162/248, 249, 250, 47, 162/49, 59, 61, 60, 62, 19, 51

[56] References Cited

U.S. PATENT DOCUMENTS

| | | | |
|---|---|---|---|
| 1,934,957 | 11/1933 | Wells | 162/60 |
| 2,195,378 | 3/1940 | Dunbar | 162/30.1 |
| 2,671,727 | 3/1954 | Westcott et al. | 162/62 |
| 4,236,961 | 12/1980 | Green | 162/61 |
| 4,690,731 | 9/1987 | Hartler et al. | 162/60 |
| 4,705,600 | 11/1987 | Jacobson | 162/60 |

*Primary Examiner*—Steve Alvo

*Attorney, Agent, or Firm*—Dirk J. Veneman; Raymond W. Campbell

[57] ABSTRACT

A method for washing pulp in a batch digester modified pulping process wherein black cooking liquor used for cooking the chips is partially displaced by pumping a first stage wash effluent into the bottom of the digester, additional amounts of the cooking liquor are displaced by pumping a second stage wash effluent, and so on, until sufficient increments of wash effluent have been pumped to displace the cooking liquor. A wash filtrate water is then pumped into the digester from a final pulp washing operation to displace the hot black liquor until all of the hot black liquor is sent to an accumulator, and the various wash effluents have been replenished in their respective stages.

8 Claims, 1 Drawing Sheet

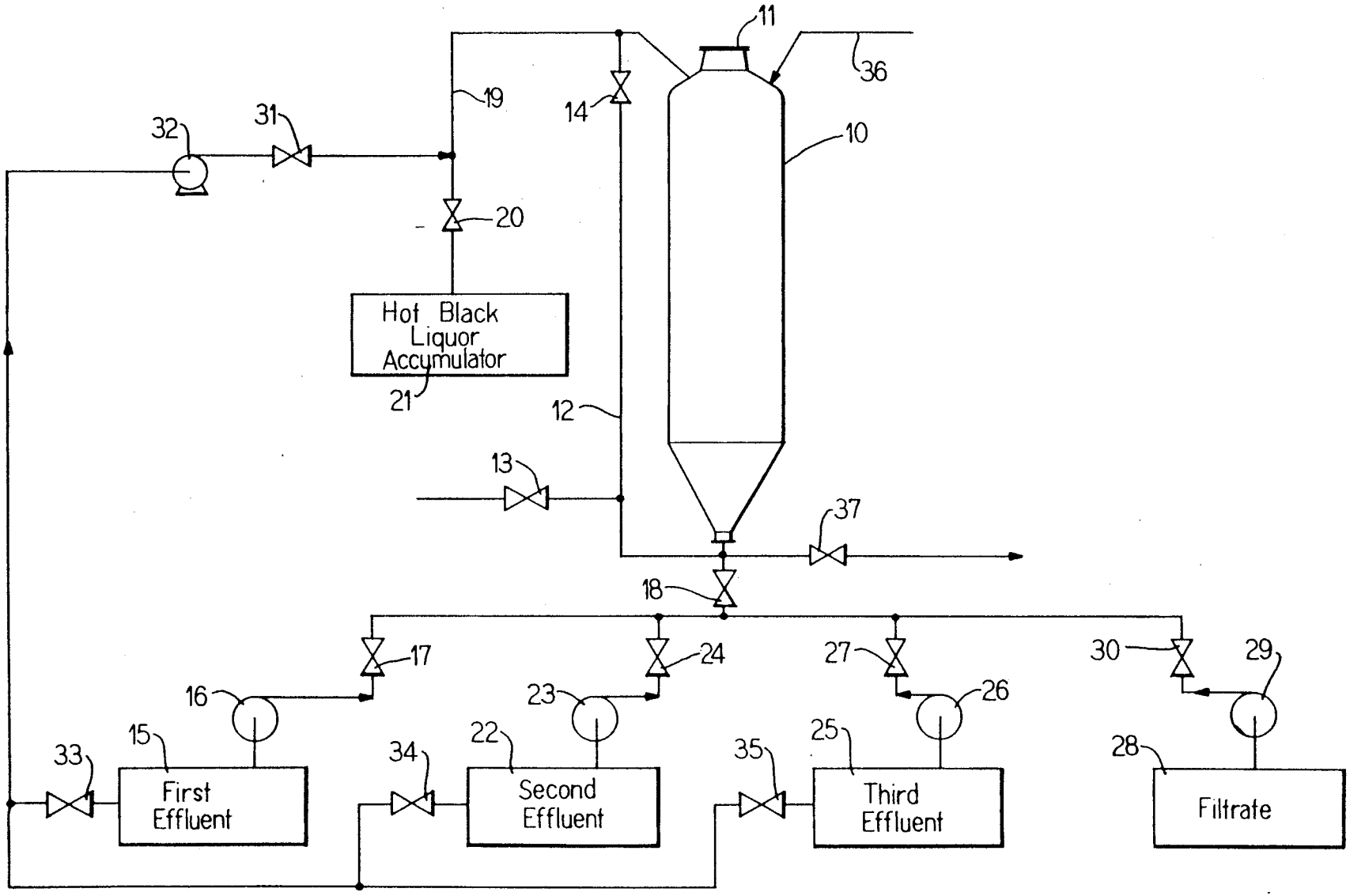
Filtrate
Third Effluent
Second Effluent
First Effluent
Hot Black Liquor Accumulator
10
11
12
13
14
15
16
17
18
19
20
21
22
23
24
25
26
27
28
29
30
31
32
33
34
35
36
37

MULTI-STAGE PULP WASHING WITHIN A BATCH DIGESTER

This is a continuation-in-part of co-pending application Ser. No. 515,493, filed on July 20, 1983, now abandoned.

BACKGROUND OF THE INVENTION

1. Field of the Invention

The present invention is directed to a process for washing pulp which has been cooked in a batch digester using a modified kraft pulping process. The invention is particularly concerned with the use of multi-stage pulp washing within the digester itself.

2. Description of the Prior Art

There are numerous types of processes for batch digestion of wood chips in the manufacture of paper, usually taking place in a digester specifically built for that purpose. The digester is filled with the wood chips which are usually compacted therein. Hot solutions of sodium hydroxide alone or in admixture with sodium sulfide are then charged into the digester. The temperature of the digester is conventionally controlled through the introduction of steam. After the chips are maintained in contact with the cooking liquor for a predetermined period of time, a blow valve in the digester is opened to dump the contents into a blow tank.

In a previously disclosed modification of this basic pulping process, the hot black liquor is displaced from the digester by pumping washer filtrate into the bottom of the digester at the end of the cook. The hot black liquor leaves the digester through an extraction screen located in the top dome of the digester. Most of the displaced hot black liquor goes to the pressurized hot black liquor accumulator and the final volume, as the temperature drops, goes to a warm black liquor accumulator. Tests have shown that pulp washing equivalent to a one-stage filter is achieved in the hot black liquor displacement. Additional pulp washing after the pulp is blown from the digester is required to achieve an acceptably low level of black liquor remaining in the pulp. This modified process is disclosed in Bertil Fagerlund's U.S. Pat. No. 4,578,149 entitled "Process For Digesting Cellulosic Material With Heat Recovery".

SUMMARY OF THE INVENTION

The process of the present invention employs a multi-stage washing operation within the digester itself so as to accomplish all or a part of the required pulp washing prior to blowing the pulp from the digester. Among the advantages of this new process are:

(1) An improved degree of pulp washing is accomplished within the digester;

(2) The process equipment requirements for pulp washing are reduced;

(3) The washing can greatly reduce or eliminate any odor causing sulfur gases in the exhaust gas from the blowing of the pulp from the digester, and (4) The overall displacement efficiency of the hot black liquor from the digester is improved, thus enhancing the energy savings.

In a typical embodiment of the present invention, the washing takes place in three stages. After the chips have been cooked with a cooking liquor to produce pulp and a hot black liquor, a portion of the hot black liquor is displaced in the digester with a first wash effluent. An additional portion of the hot black liquor in the digester is displaced with a second wash effluent having a lower concentration of black liquor than the first wash effluent. Finally, another portion of the hot black liquor is displaced with a third wash effluent which has a still lower concentration of black liquor than either of the first two effluents. The remaining contents of the digester are displaced with a washer filtrate water and the supplies of first, second and third wash effluents are sequentially replenished from the liquid displaced from the digester. In accordance with the present invention, the first and second effluents as well as the liquor are introduced into the digester 10 under conditions which minimize mixing of the first and second effluents and the liquor and establish minimal interface zones in the digester between the first effluent and the liquor, and between the first and second effluents.

The pulp washing process of the present invention finds particular use with the batch digester modified kraft pulping process, but it also has application in other batch digester pulping systems such as a sulphite pulping system.

BRIEF DESCRIPTION OF THE DRAWINGS

The single Figure of the drawings consists of a schematic flow diagram illustrating a multi-stage pulp washing system of the present invention, when employing three washing stages.

DESCRIPTION OF THE PREFERRED EMBODIMENTS

The multi-stage washing process of the present invention can be successfully applied to washing in a digester because of the discovery that when liquor is displaced from a digester by pumping liquor or wash water in the bottom of the digester and removing the displaced liquor from the top, a very efficient displacement can be accomplished in a short time, usually less than 30 minutes. The reason for this was found to be that the pulp in the digester at the end of the cook remains in the form of chips and sinks to the bottom of the digester. Since the pulp sinks in the digester there is no pulp at the top of the digester to plug the outlet screens or restrict the displaced liquor flow from the digester. The observed pulp sinking was found to be true of all types of wood tested which range from low density spruce to high density hardwoods.

Turning now to the drawing, reference numeral 10 has been applied generally to a conventional digester of the batch type including a removable lid 11. Steam is introduced into a circulating line 12 through a valve 13 into the bottom of the digester and circulates through a valve 14 to bring the wood chips which are packed into the digester 10 up to a cooking temperature.

At the completion of the cooking operation when the digester is substantially filled with a mixture of pulp and hot black liquor, a partial displacement of hot black liquor from the digester commences by pumping an effluent from a first stage wash effluent accumulator 15 by means of a pump 16 through a valve 17 and into the base of the digester 10 through an inlet valve 18. Hot black liquor is displaced from the digester 10 through a line 19 and a valve 20 into a hot black liquor accumulator 21. The volume of first stage wash effluent pumped into the digester will depend on system requirements such as the number of wash stages employed, the required pulp cleanliness after washing, the time available, and the allowable dilution of the black liquor with wash water. The volume of wash effluent pumped into the digester is preferably not in excess of one-half the digester volume and will normally be in the range of 10 to 30% of the digester volume.

After pumping the initial volume of first stage wash effluent into the digester, the displacement of hot black liquor from the digester 10 to the accumulator 21 is continued by pumping effluent from a second stage wash effluent accumulator 22 by means of a pump 23 through a valve 24 into the base of the digester through the inlet valve 18. This second wash effluent has a lower concentration of black liquor than the first wash effluent and has a volume not in excess of one-half the digester volume.

After pumping an additional amount of second stage wash effluent into the digester to thereby displace additional amounts of hot black liquor into the accumulator 21, the flow from the accumulator 22 is stopped and the effluent from a third stage wash effluent accumulator 25 is pumped by means of a pump 26 through a valve 27, through inlet valve 18, into the bottom of the accumulator 10. Additional amounts of hot black liquor are thus displaced into the hot black liquor accumulator 21. The third stage wash effluent also is preferably added in an amount not exceeding one-half the digester volume.

The next stage consists in pumping a wash filtrate water from a reservoir 28 by means of a pump 29 through a valve 30 into the inlet valve 18 at the base of the digester. The filtrate water is normally almost devoid of any black liquor concentration The wash filtrate water may be added in an amount not significantly greater than the volume of the digester. After the proper volume of hot black liquor has been accumulated in the accumulator 21, the valve 20 is closed and a valve 31 is opened so that the various effluent fractions are returned to their accumulators using a pump 32 if necessary. The displacement with wash filtrate from the reservoir 28 delivers first stage wash effluent into the accumulator 15 through a valve 33 to replenish the amount of first stage effluent used initially in displacing hot black liquor. When that amount of effluent has been recovered, the valve 33 is closed and a valve 34 is opened to direct flow into the second stage effluent accumulator 22. Upon replenishment of the effluent used in the original displacement, valve 34 is closed and a valve 35 is opened to direct the less concentrated wash effluent back into the third stage wash effluent accumulator 25. This completes the pulp washing operation in the digester.

The pulp and the remaining liquid are then blown from the digester 10 by means of compressed air entering through a compressed air line 36 and the contents of the digester 10 are directed to a blow tank through a valve 37. In summary, the first stage wash effluent displaces a portion of the hot black liquor near the inlet, moving the entire black liquor volume toward the outlet, with some of the black liquor being moved out of the outlet if the digester was hydraulically full or nearly so. The second effluent displaces the first effluent in the digester and moves the first effluent toward the outlet of the digester, displacing some of the hot black liquor out of the digester. The third wash effluent displaces another portion of the hot black liquor out of the digester and displaces the second effluent in the digester, moving the first and second effluents toward the outlet. The various displacements are carried out while minimizing mixing of the liquor and the effluents, and establishing minimal interface zones between the liquor and the effluents, between first and second effluents, between the second and third effluents, and between the third effluent and the wash water.

Since most of the black liquor has been removed from the pulp by the washing process, there should be substantially no odorous sulfur gases released with the air from the blow tank. In trials using the modified system of the present invention where the black liquor was displaced from the digester, it was found that there is more than a 98% reduction in odorous sulfur gases as compared to the release from a conventional kraft digester blow. The air from this blow tank can be vented to the atmosphere with no environmental problem when the new pulp washing system of the present invention is employed.

As a specific example of a system according to the present invention, the relative concentration of black liquor, expressed as percent of dissolved dry black liquor solids in the washing fractions may be as follows:

| Black Liquor | Wash Liquid |
|---|---|
| Hot Black Liquor | 20% |
| First Effluent | 14% |
| Second Effluent | 5% |
| Third Effluent | 2% |
| Wash Filtrate | 1% |

The flows for a typical 6000 cu. ft. kraft digester could be as follows:

| FLOW INTO DIGESTER | | |
|---|---|---|
| Source | Cubic Feet | Gallons |
| First Effluent | 1000 | 7,480 |
| Second Effluent | 1000 | 7,480 |
| Third Effluent | 1000 | 7,480 |
| Filtrate | 6000 | 44,880 |
| TOTAL | 9000 | 67,320 |
| **FLOW OUT OF DIGESTER** | | |
| To | Cubic Feet | Gallons |
| Hot Liquor Accumulator | 6000 | 44,880 |
| First Effluent | 1000 | 7,480 |
| Second Effluent | 1000 | 7,480 |
| Third Effluent | 1000 | 7,480 |
| | 9000 | 67,320 |

It should be evident that various modifications can be made to the described embodiments without departing from the scope of the present invention.

I claim as my invention:

1. A method for cooking and washing pulp in a batch digester and for subjecting the pulp to multiple stages of pulp washing which comprises:

filling a digester with wood chips and cooking liquor, cooking said wood chips in said digester with said cooking liquor in a substantially stationary column to produce pulp and a hot black liquor, when said cooking is completed and while maintaining said pulp in a substantially undisturbed and stationary column in said digester, displacing a first portion of said black liquor substantially less than the volume of said digester from said digester through an outlet at the upper end of said digester by introducing into the bottom of said digester a first wash effluent, displacing a second portion of the remaining black liquor substantially less than the volume of said digester from said digester through said outlet by introducing into the bottom of said digester a second wash effluent having a lower black liquor concentration than said first wash effluent, said second wash effluent displacing said first wash effluent in said digester and moving said first wash effluent toward said outlet at the upper end of said digester, minimizing mixing of said first and second effluents and said liquor and establishing minimal interface zones in the digester between said first effluent and said liquor and between said first and second effluents, directing the displaced hot black liquor portions to an accumulator, directing the first and second wash effluents from said digester to separate storage means, and emptying the pulp and remaining liquid from said digester after said black liquor portions have been displaced.

2. A method according to claim 1 in which said first and second wash effluents are displaced from said digester with a washer filtrate water.

3. A method according to claim 1 which includes the additional step of displacing a third portion of said black liquor with a third wash effluent.

4. A method according to claim 1 in which said cooking liquor is an alkaline kraft liquor.

5. A method according to claim 1 in which said cooking liquor is a sulphite cooking liquor.

6. A method according to claim 3 in which:

said third wash effluent has a lower concentration of black liquor than said second wash effluent.

7. A method for cooking wood chips and washing the resulting pulp in a batch digester having a liquid inlet and a liquid outlet vertically spaced from each other which comprises:

cooking said wood chips in a digester with a cooking liquor to produce pulp and a hot black liquor, after the cooking is completed and while the cooked pulp remains substantially stationary in the digester, displacing a portion of the hot black liquor out of said digester by pumping a first wash effluent through said inlet, displacing an additional portion of the hot black liquor out of said digester by pumping through said inlet a second wash effluent having a lower concentration of black liquor than said first wash effluent, said second effluent displacing said first effluent in said digester and moving said first effluent toward said outlet, displacing another portion of the hot black liquor out of said digester by pumping into said digester a third wash effluent having a lower concentration of black liquor than said second wash effluent, said third wash effluent displacing said second effluent in said digester and moving said first and second effluents toward said outlet, displacing the remaining contents of said digester with a washer filtrate water, minimizing mixing of said liquor and said effluents and establishing minimal interface zones between said liquor and said first effluent, said first and second effluents, said second and third effluents and said third effluent and said water, and sequentially replenishing the supplies of first, second and third wash effluent from the liquid displaced from said digester.

8. A method for cooking wood chips and washing the resulting pulp in a batch digester having an outlet vertically spaced from an inlet which comprises:

cooking said wood chips in said digester with a cooking liquor to produce pulp and a hot black liquor, after the cooking is completed and while the cooked pulp remains substantially stationary in the digester displacing a portion of the hot black liquor vertically through said outlet with a volume of a first wash effluent in an amount not in excess of about one-half of the digester volume, displacing a second portion of the remaining black liquor vertically through said outlet with a volume of a second wash effluent having a lower concentration of black liquor than said first wash effluent and a volume not in excess of about one-half of the digester volume, displacing another portion of the hot black liquor vertically through said outlet with a third wash effluent having a lower concentration of black liquor than said second wash effluent and a volume not in excess of about one-half of the digester volume, displacing the remaining contents of said digester with a washer filtrate water at a volume not significantly greater than the volume of said digester, and sequentially replenishing the supplies of first, second and third wash effluents from the liquid displaced from said digester.

* * * * *